US005324128A

United States Patent [19]

Gueret

[11] Patent Number: 5,324,128

[45] Date of Patent: Jun. 28, 1994

[54] SPILL PREVENTING COSMETIC APPLICATOR

[75] Inventor: Jean-Louis H. Gueret, Paris, France

[73] Assignee: L'Oreal, Paris, France

[21] Appl. No.: 988,965

[22] PCT Filed: Jul. 15, 1992

[86] PCT No.: PCT/FR92/00680

§ 371 Date: Apr. 13, 1993

§ 102(e) Date: Apr. 13, 1993

[87] PCT Pub. No.: WO93/01734

PCT Pub. Date: Feb. 4, 1993

[30] Foreign Application Priority Data

Jul. 19, 1991 [FR] France ..... 91 09149

[51] Int. Cl.[5] ..... A45D 34/00; A45D 40/20

[52] U.S. Cl. ..... 401/126; 401/122; 401/129; 401/130

[58] Field of Search ..... 401/129, 130, 122, 126

[56] References Cited

U.S. PATENT DOCUMENTS 2,691,184 10/1954 Miller et al. .
3,115,270 12/1963 Melnikoff .
3,951,157 4/1976 Idec .
4,189,245 2/1980 Bennett ..... 401/129 X
4,796,647 1/1989 Gueret .
4,841,996 6/1989 Gueret ..... 401/129 X
4,974,980 12/1990 Gueret .

FOREIGN PATENT DOCUMENTS 0354823 2/1990 European Pat. Off. .
0379692 8/1990 European Pat. Off. .
3149075 6/1983 Fed. Rep. of Germany .
1076477 10/1954 France .
1517002 2/1968 France .
2470737 6/1981 France .
2603780 3/1988 France .
2094235 9/1982 United Kingdom .

*Primary Examiner*—Steven A. Bratlie
*Attorney, Agent, or Firm*—Cushman, Darby and Cushman

[57] ABSTRACT

The applicator assembly (1) is characterised in that the bottle (3) comprises a case supplied by capillary slots (11, 12). In order to obtain good impregnation, the case (10) has an internal shape (25) similar to that of the applicator end piece (6). The stem (7) comprises a shoulder (8) which bears against a sealing seat (9). A locking device (17, 15) is provided in the next and in the stem in order to keep the shoulder (8) in bearing contact against the seat (9). The applicator and the bottle are provided with a system having corresponding undulations (16) so that opening is effected gradually by rotating the cap (5) slightly about its axis.

18 Claims, 3 Drawing Sheets

SPILL PREVENTING COSMETIC APPLICATOR

FIELD OF THE INVENTION

This invention relates to an applicator assembly for a liquid or pasty product, such as a cosmetic product. It relates more particularly, but not exclusively, to eyeliner or mascara products.

BACKGROUND OF THE INVENTION

An applicator assembly of this kind is known, inter alia, from French Patent Specification No. 2 603 780, which describes a bottle comprising a neck, the opening of which narrows towards the bottom of the bottle to end in a passage into which the end of an applicator brush penetrates in order to be impregnated with the cosmetic product. In the case of an eyeliner tip, i.e. a very fine tip, the passage has a very small diameter in which sufficient capillary action is produced that the bottle does not leak, even if it is turned upside down. In the case of a mascara product, the applicator necessarily has a larger diameter, so that the diameter of the passage is at least of the order of 2 to 3.5 mm. In this case, the bottle leaks if it is turned upside down as there is no longer any capillary action.

SUMMARY OF THE INVENTION

The aim of this invention is to obviate this disadvantage.

In order to solve this problem, it is proposed according to the invention to dispose the applicator element in a case which prevents the passage of the product towards the exterior. However, capillary orifices are formed in the case in order to maintain impregnation of the applicator element by capillary action. U.S. Pat. No. 3,951,157 had already proposed, in a similar assembly, mounting an applicator element in a case provided with slots, but these non-capillary slots cooperated with a pulverulent product and would not have been able to prevent the flow of a liquid product.

FR-A-1 517 002 relates to a nail varnish bottle comprising a tubular container receiving the applicator, this tubular container communicating with the interior of the bottle by means of a filling hole which is not a capillary orifice.

FR-A-1 076 477 relates to a deformable seal intended more particularly for products based on very volatile solvents, e.g. nail varnishes, and does not include a capillary orifice.

This invention therefore relates to an applicator assembly for a liquid or pasty product, such as a cosmetic product, comprising a bottle which defines a container for the product and which is provided with a neck and a movable cap capable of closing the neck of the bottle, the cap being provided in its interior with a stem to the end of which an applicator element is fixed in such a manner that, in the closed position of the cap, the applicator element penetrates into the bottle and is impregnated with the product, a shoulder being provided on the cap and being adapted, in the closed position of the cap, to bear against a seat integral with the bottle, the said bottle including a case, the inner recess of which is adapted to the external shape of the applicator element, the said case being disposed in such a manner that, in the closed position of the cap, the applicator element is housed therein, characterised in that the shoulder is an annular shoulder formed on the stem, the said seat having a corresponding shape and comprising a central orifice for the passage of the said applicator element from one side of the seat to the other, the said seat being connected to the said case, the said case comprising in its wall at least one capillary opening allowing the product to impregnate the applicator element, but preventing the flow of the product from the container in which it is situated towards the exterior.

The mounting of the applicator element therefore no longer results in leakage of the product, as was the case in French Patent Specification No. 2 603 780, as the product must pass into the capillary openings in the case. The applicator element is no longer immersed directly in the product contained in the bottle, this moreover preventing contamination of the container by the applicator element, but instead it becomes impregnated with the product in a sort of mini auxiliary container formed by the case, the said case being supplied with product by a capillary passage which is peculiar thereto and is independent of the presence of the applicator element. This fact alone already ensures a certain retention of the product, even if the bottle is turned upside down. Nevertheless, the applicator assembly is advantageously made with a sealing seat arranged in the bottle and made of a flexible material.

According to a preferred embodiment, the stem of the cap of the applicator assembly comprises an annular snap element situated between the shoulder and the cap, opposite a corresponding snap element arranged in the bottle, one of the annular elements locking on to the other and thereby ensuring that the cap is held on the bottle in the closed position, with pressure being created between the shoulder of the stem and the sealing seat. The use of a snap closure means that it is possible to avoid a screw-in closure, involving the use of a large external diameter for the applicator assembly. In this manner, the packaging according to the invention can be more aesthetically pleasing.

The neck and the cap of the applicator assembly advantageously comprise in an annular manner corresponding undulating shapes, so that relative rotation of the cap with respect to the bottle results in gradual axial displacement of one with respect to the other, sufficient to cause release of the snap elements of the stem and the bottle. Therefore, in order to prevent too sudden opening, a system of the kind described, e.g. in French Patent Specification No. 2 470 737, allows for gradual opening so that the separation of the cap from the neck is effected without a sudden jolt, even in the case of very firm locking in order to ensure effective support of the shoulder of the stem on its sealing seat.

It is clear that the cross section of the capillary opening (or openings) of the case will be all the greater the more viscous the product. Capillary openings each having a cross section of between 0.1 and 25 $mm^2$ are preferably provided. The outer wall of the case is advantageously provided with at least one capillary groove ending in a capillary opening, the groove being formed, e.g. in an axial plane of the case. According to another possibility, the groove may have an annular shape along a plane perpendicular to the axis of the case. The groove may defined, inter alia, by two edges which converge towards the capillary opening over the entire thickness of the wall of the case. These grooves facilitate the supply of product by the capillary openings and form reserves for the impregnation of the applicator element.

When the applicator element has a generally cylindrical shape, it may be provided, for good wiping of the applicator element, that the orifice of the seat has a slightly smaller section than that of the applicator element.

According to a preferred embodiment, the snap element arranged in the bottle to keep the cap in the closed position is formed on a cross member which itself supports an end piece, one end of which forms the case, the said end piece being provided with an axial bore in which the sealing seat is arranged.

According to a variant, the sealing seat arranged in the bottle is made of a flexible material. It may also be provided that the cross member is made of flexible material, in particular so that the locking of the cap on to the neck ensures an elastically maintained supporting force of the shoulder of the stem on its seat.

All sorts of applicator elements are provided for, inter alia, brush or felt-tip applicator, pen, sponge, these possibly being flocked.

BRIEF DESCRIPTION OF THE DRAWINGS

This invention will be more readily understood from the description of two embodiments given purely by way of non-limiting examples and illustrated in the accompanying drawings, in which.

DETAILED DESCRIPTION OF THE INVENTION

Figure 1:
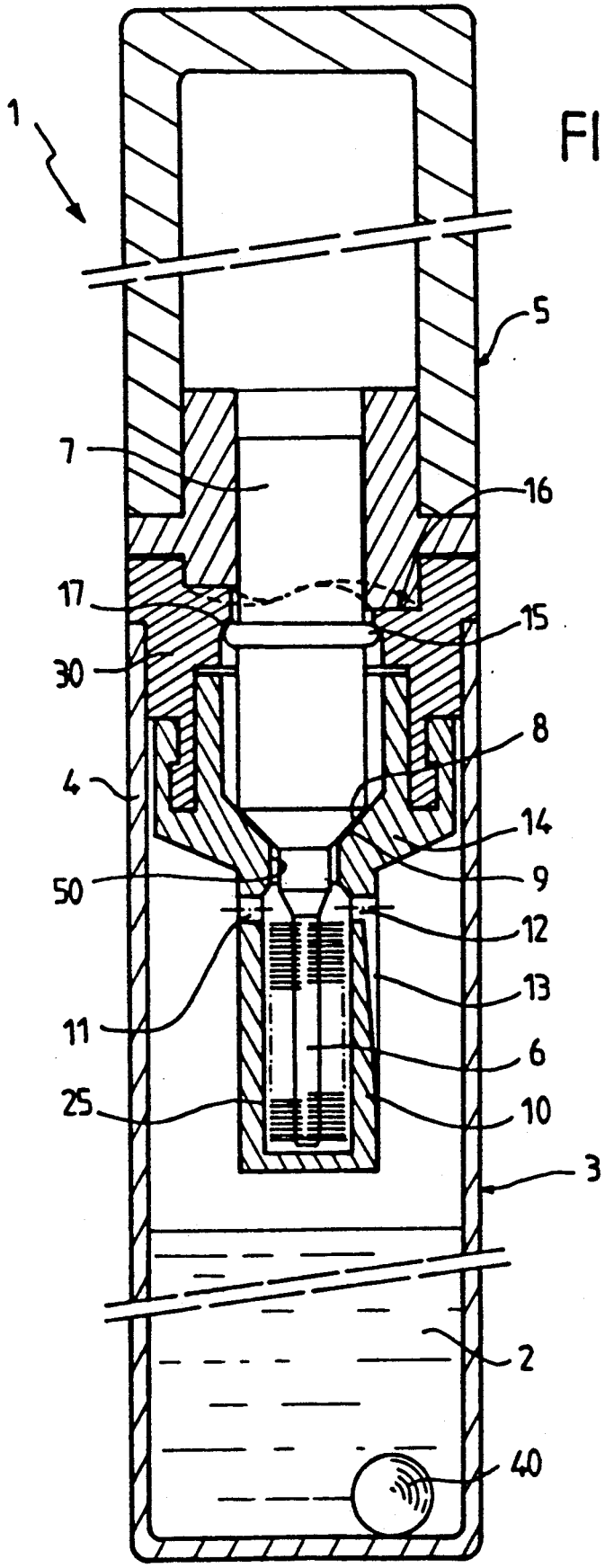
FIG. 1 is an axial section of an applicator assembly according to a first variant of the invention.

FIG. 1 shows an applicator assembly 1 in the closed position, comprising a bottle 3 provided with a neck 4 and a cap 5 to close the neck. The bottle 3 forms a container for the product 2, e.g. a mascara, which is to be dispensed with the said applicator assembly.

The cap is provided with an integral stem 7 to the end of which an applicator element 6 is fixed, which, in the case of FIG. 1, is a brush provided with very dense bristles. However, this could equally be a felt-tip applicator, a pen or a sponge, which may or may not be flocked, or any other element suitable for the application of the product 2. The shape shown is substantially cylindrical, but a slightly conical applicator element with a pointed tip could also be used.

The applicator element 6 is housed in a case 10 integral with the bottle 3. The internal shape of the case 10 is adapted to the external shape of the applicator element 6 so that the latter is impregnated with the product 2, the said product penetrating into the case through at least one capillary opening. Two variants of capillary openings are shown, namely:

- a circular opening 11 with a sufficient diameter as a function of the viscosity of the product, and
- a rectangular opening 12 connected to a groove 13 is arranged longitudinally on the outer surface of the case 10, the groove 13 having, in an axial plane of the case 10, a triangular shape, one vertex of the triangle being occupied by the opening 12.

It is clear that it is preferable for there to several capillary openings in one single assembly, and for them all to have the same shape, the two types of openings shown in the one FIG. 1 being intended simply to illustrate two possible embodiments of the openings.

In both cases, as a function of the viscosity of the product, the latter may form a capillary reserve for the product ready to impregnate the applicator element 6 at the opening 11, 12. The groove 13 facilitates access of the product to the opening 12 and forms a reserve supply.

A ball 40 may be placed in the container of the bottle 3 in order to homogenise the product, and/or to break its thixotropy by stirring.

As a result of the fact that the product 2 can only emerge from the bottle through the capillary openings 11, 12, the applicator assembly is already relatively tight both in the open position and in the closed position. It is nevertheless preferable to provide it with a sealing system acting in the closed position, such as the one shown, produced by the cooperation of a truncated annular shoulder 8 arranged on the stem 7 with a truncated seat 9 of corresponding shape arranged on a cross member 30 inserted into the bottle. The case 10 forms one of the ends of an end piece 14 which is held mechanically by its other end on the cross member 30. The supporting force required for this sealing system is obtained by a snap bead 15 provided on the stem 7 to bear against a shoulder 17 arranged in the neck of the bottle 3.

A constriction 50 is provided in the end piece 14 and allows the said brush to be wiped when the user is going to use it by removing it from the bottle 3. Any excess product 2 is removed in this manner as a result of the diameter of the orifice 50 which is slightly smaller than the external diameter of the brush 6.

The presence of the snap bead 15 and the shoulder 17 produces a snap effect both upon closing, this being desired for sealing, and upon opening, which may be disadvantageous, causing, e.g. the possible risk of spraying of drops of the product. In order to prevent this, on the one hand, a certain flexibility is provided in the method of fixing the end piece 14 in the bottle 3 and, on the other hand, an opening system having undulations of the type described in French Patent Specification No. 2 470 737 is provided.

The desired flexibility is provided by means of the end piece 14 which forms, on the one hand, the sealing seat 9 and, on the other hand, the case 10, although this is not essential. This single component is made of a flexible material. The flexible material capable of providing the required flexibility may be, e.g. a natural rubber, a polyurethane, a thermoplastic elastomer, a nitrile or silicone rubber or even a polyethylene.

A simple, and therefore gradual, opening system can be produced by means of corresponding undulating shapes 16 disposed opposite one another on the neck of the bottle 3 and on the cap 5, so that, by rotating the cap 5 slightly about its axis, sufficient axial force is exerted to release the snap bead 15 from the shoulder 17. In this variant, the undulations 16 are in the interior of the applicator assembly so that they are not seen from the exterior.

Figure 2:
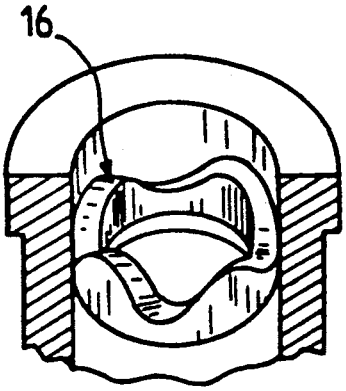
FIG. 2 is a detail of the undulating opening system of the applicator of FIG. 1.

The undulating opening system can be visualised well from FIG. 2. In the closed position of the cap, the undulations interlock with one another like gears. For opening, by imparting a rotational movement to the cap 5 as if it were being screwed, the undulations slide on to one another, causing axial displacement of the cap 5 with respect to the bottle 3, as the force resulting from the torque exerted in the direction of rotation is decomposed by reaction into two components, one of which is axial and causes rising of the cap 5 and its associated applicator element 6.

Figure 3:
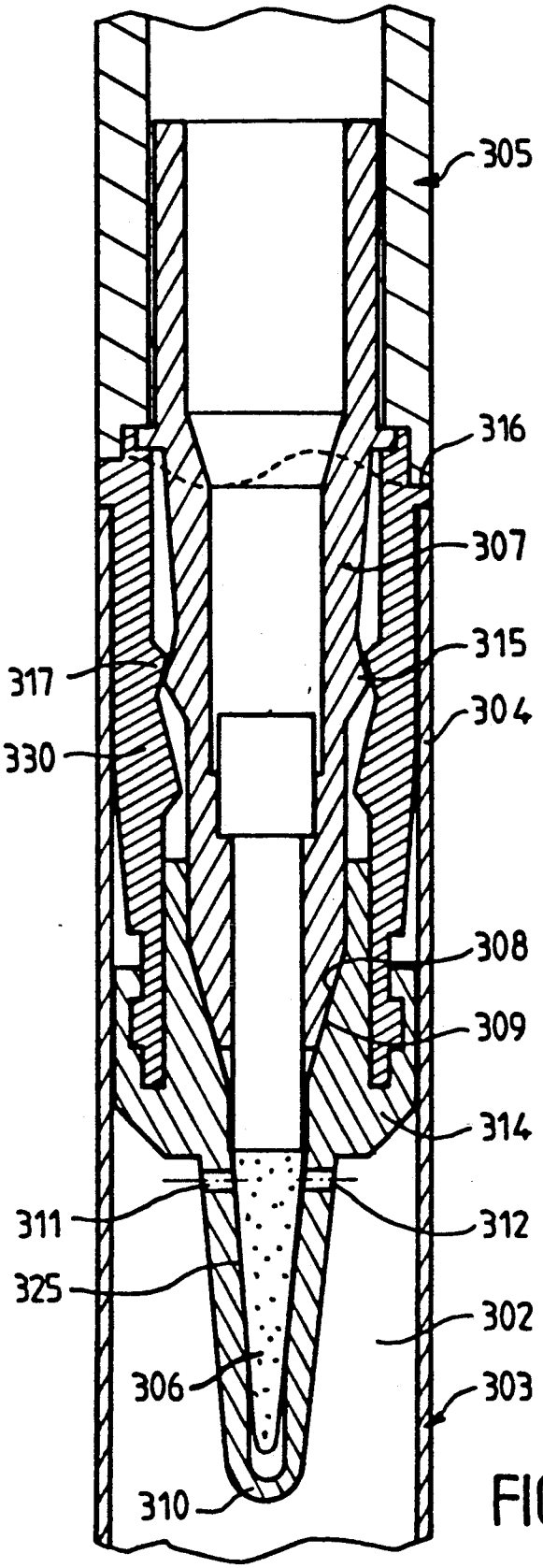
FIG. 3 is an axial section of an applicator assembly according to a second variant of the invention.

FIG. 3 shows a variant relatively similar to that of FIG. 1. Similar elements have the same reference numerals increased by 300. The bottle 303 is provided with a neck 304. The cap 305 is provided with an applicator element 306 carried by a stem 307. A cross member 330 is mounted in the neck 304, the upper edge of which is fastened to the free edge of the neck and the lower part of which supports an end piece 314, the lower part of the said end piece forming a case 310 in which the applicator element 306 is housed. The applicator element 306 is made of sponge and has a slightly conical shape. For this reason, the case 310 also has a slightly conical internal surface 325 in order to obtain good impregnation by the product 302. The product 302 penetrates into the case 310 through two capillary openings 311, 312, shown here to be identical, with a circular section.

In the embodiment according to FIG. 3, a swabbing effect is produced when the applicator 306 is inserted and removed. When it is removed, this swabbing effect creates a negative pressure, resulting in an improvement in the passage of the liquid towards the applicator precisely at the moment it is removed.

Figure 6:
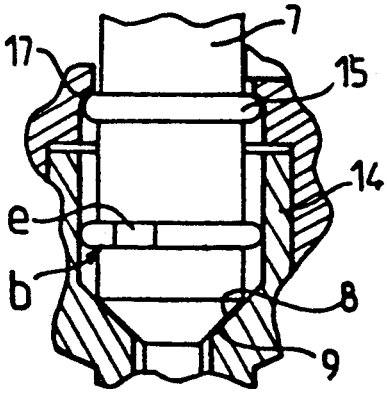
FIG. 6 shows the modification of a detail from FIG. 1.

The same result can be obtained with the embodiment of FIG. 1 if a flange b (see FIG. 6) bearing against the cylindrical walls of the element 14 is mounted on the cylindrical part disposed between the bead 15 and the conical bearing surface 8. In order to prevent an excessive swabbing effect, this flange can be interrupted by notches e so as to create a leak, but a slight negative pressure will still be created when the applicator is removed.

Figure 4:
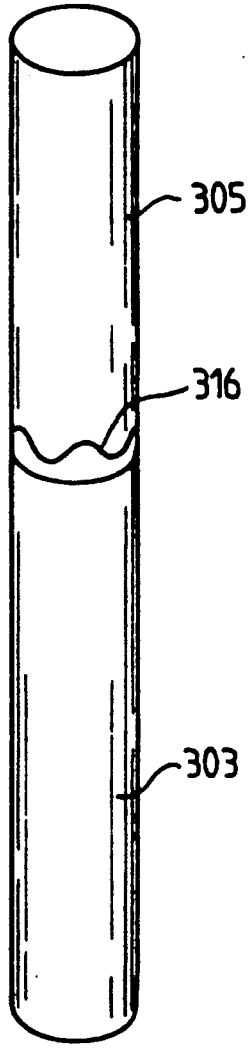
FIG. 4 is a perspective view of the undulating opening system of this second variant.

In the variant of FIG. 3, there is no wiper device, as this would be ineffective in view of the conicity of the applicator element 306. The stem 307 comprises a truncated bearing surface 308 which bears against a truncated seat 309 adapted so that the whole thing forms a sealing system similar to that of FIG. 1 designated by the reference numerals 8 and 9. The seat 309 is formed in the axial bore of the end piece 314. The locking element is produced by the cooperation of a shoulder 317 of the cross member 330 with a shoulder 315 of the stem 307. In this variant, the cross member 330 is much longer and thinner than that of FIG. 1, and it is made of flexible material. Upon locking, the stem 307 is pushed elastically towards the truncated seat 309, thereby ensuring good sealing by support (seat 309/bearing surface 308). The opening system of the bottle comprises annular undulations 316 formed on the neck 304 and the cap 305. These undulations overlap with one another as in the embodiment of FIG. 1, but in this case they are produced externally on the surface of the bottle 303, so that the undulations 316 are visible from the exterior. This external visibility is shown clearly in FIG. 4 by virtue of the perspective view. The mode of action of the undulations 316 is exactly the same as in the case of FIGS. 1 and 2.

Figure 5:
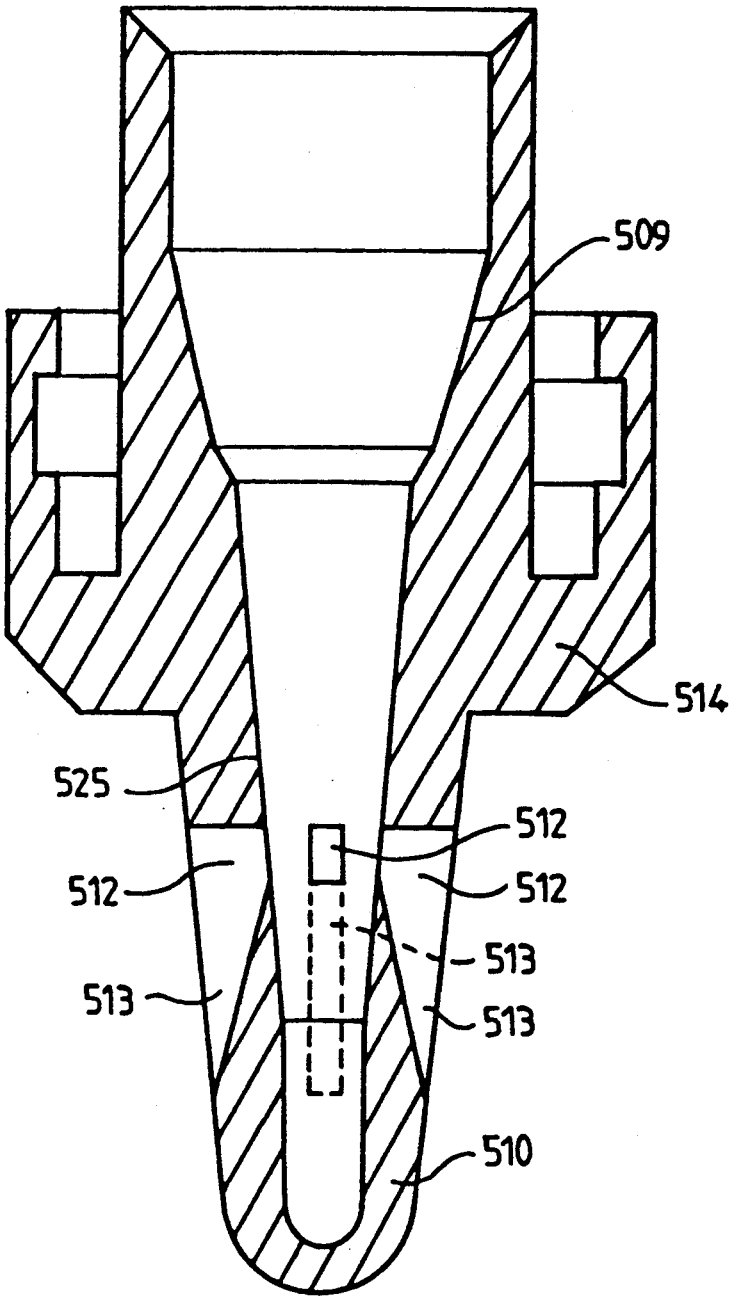
FIG. 5 is a detail of a variant of the end piece of the applicator assembly of FIG. 3.

FIG. 5 is an axial section of an end piece 514 suitable for a slightly conical applicator element (not shown). In this example, the case 510 comprises four capillary openings 512 (three of which can be seen in FIG. 5) of rectangular section, at the end of four grooves 513, to bring the product to the impregnation zone. The internal shape 525 of the case 510 has a conicity corresponding to that of the applicator element. The reference numeral 509 designates the truncated seat which ensures sealing by cooperation with a bearing surface of the same type as the applicator element. This end piece 514 can be made of flexible material and it is adapted to be inserted into a bottle in the same manner as the end piece 314 for the variant of FIG. 3.

I claim:

1. An applicator assembly for a cosmetic product, comprising a bottle for the product, said bottle having a neck provided with a removable cap for closing the next of the bottle, said cap having a side carrying a stem, said stem having an end to which an applicator element is fixed in such a manner that, in the closed position of said cap on said neck, said applicator element penetrates into the bottle and is impregnated with the product, a shoulder being provided on the cap and said bottle having an interior seat, said shoulder being adapted, in the closed position of the cap, to bear against said seat, said bottle including a case having an inner recess which is shaped of complement the external shape of the applicator element, said case being disposed in such a manner that, in the closed position of the cap, the applicator element is housed therein, said shoulder being an annular shoulder formed on said stem, the said seat having a shape corresponding to the shape of said shoulder and comprising a central orifice for the passage of the said applicator element from one side of the seat to the other into said case connected to the said sat, said case comprising a wall having at least one capillary opening allowing the product to impregnate the applicator element, but preventing the flow of the product from the container in which it is situated towards the exterior.

2. The applicator assembly as claimed in claim 1, wherein said stem comprises an annular snap element situated between said shoulder and said cap, opposite a corresponding snap element disposed in said bottle, one of said annular snap elements locking onto the other thereby ensuring that the cap is held on the bottle in a closed position with pressure being created between said shoulder of said stem and said seat.

3. The applicator assembly as claimed in claim 2, wherein said neck and said cap comprise complementary undulating surfaces whereby relative rotation of said cap with respect to said bottle results in gradual axial displacement between said cap and said bottle sufficient to cause release of said snap elements of said stem and said bottle.

4. The applicator assembly as claimed in claim 2, wherein said snap element carried in said bottle is formed on a cross member which itself supports and end piece, one end of which forms said case, said end piece being provided with an axial bore in which sealing seat is formed.

5. Applicator assembly according to claim 4 wherein said sealing seat 9, 509 arranged in the bottle is made of a flexible material.

6. Applicator assembly according to claim 4, characterised in that the cross member 330 is made of flexible material.

7. Applicator assembly according to claim 6 wherein said applicator element is a brush.

8. The applicator as claimed in claim 6 wherein said applicator element is a felt-tipped applicator.

9. The applicator as claimed in claim 6 wherein said applicator element is a sponge.

10. The applicator as claimed in claim 6 wherein said applicator element is a pen.

11. The applicator as claimed in claim 6 wherein said applicator element is a flocked surface member.

12. The applicator assembly as claimed in claim 1, wherein the size of capillary opening is selected to correspond to the viscosity of the product.

13. The applicator assembly as claimed in claim 12, wherein each capillary opening has a cross section of between 0.1 and 25 $mm^2$.

14. Applicator assembly according to claim 13 wherein the outer wall of the case is provided with at least one capillary groove 13, 513 ending in a capillary opening 12, 512.

15. Applicator assembly according to claim 14, characterised in that the groove 13, 513 is formed in an axial plane of the case 10, 310.

16. Applicator assembly according to claim 15 wherein the groove 13, 513 is defined in the axial plane by two edges which converge towards the capillary opening over the entire thickness of the wall of the case (10, 510).

17. Applicator assembly according to claim 16 wherein the applicator element is substantially cylindrical and that the orifice 50 of the seat 9 has a slightly smaller section than that of the applicator element 6.

18. Applicator assembly according to claim 14, characterised in that the groove is formed in an annular shape along a plane perpendicular to the axis of the case.

* * * * *

US005324128B1

REEXAMINATION CERTIFICATE (3478th)

United States Patent [19] [11] B1 5,324,128

Gueret [45] Certificate Issued Apr. 7, 1998

[54] SPILL PREVENTING COSMETIC APPLICATOR

[75] Inventor: Jean-Louis H. Gueret, Paris, France

[73] Assignee: L'Oreal, Paris, France

Reexamination Request:
No. 90/004,493, Dec. 20, 1996

Reexamination Certificate for:

| | |
|---|---|
| Patent No.: | **5,324,128** |
| Issued: | **Jun. 28, 1994** |
| Appl. No.: | **988,965** |
| Filed: | **Jul. 15, 1992** |

[22] PCT Filed: Jul. 15, 1992

[86] PCT No.: PCT/FR92/00680

§ 371 Date: Apr. 13, 1993

§ 102(e) Date: Apr. 13, 1993

[87] PCT Pub. No.: WO93/01734

PCT Pub. Date: Feb. 4, 1993

[30] Foreign Application Priority Data

Jul. 19, 1991 [FR] France ..... 91 09149

[51] Int. Cl.[6] ..... A45D 34/00; A45D 40/20

[52] U.S. Cl. ..... 401/126; 401/122; 401/129; 401/130

[58] Field of Search ..... 401/126, 129, 401/130

[56] References Cited

U.S. PATENT DOCUMENTS

| | | | |
|---|---|---|---|
| 2,691,184 | 10/1954 | Miller et al. . | |
| 3,115,270 | 12/1963 | Meinikoff . | |
| 3,246,657 | 4/1966 | Roller, Sr. . | |
| 3,311,941 | 4/1967 | Buchwalter et al. . | |
| 3,951,157 | 4/1976 | Idee . | |
| 4,101,225 | 7/1978 | Linz et al. . | |
| 4,572,224 | 2/1986 | Rosenwinkel et al. | 401/122 X |
| 4,796,647 | 1/1989 | Gueret . | |
| 4,974,980 | 12/1990 | Gueret . | |
| 5,242,232 | 9/1993 | Kuhn et al. | 401/122 |

FOREIGN PATENT DOCUMENTS

| | | |
|---|---|---|
| A-0354823 | 2/1990 | European Pat. Off. . |
| A-0379692 | 8/1990 | European Pat. Off. . |
| A-1076477 | 4/1953 | France . |
| A-1517002 | 1/1967 | France . |
| A-2470737 | 6/1981 | France . |
| A-2603780 | 3/1988 | France . |
| A-31 49 075 | 6/1983 | Netherlands . |
| A-2094235 | 9/1982 | United Kingdom . |

*Primary Examiner*—Steven A. Bratlie

[57] ABSTRACT

The applicator assembly (1) is characterised in that the bottle (3) comprises a case supplied by capillary slots (11, 12). In order to obtain good impregnation, the case (10) has an internal shape (25) similar to that of the applicator end piece (6). The stem (7) comprises a shoulder (8) which bears against a sealing seat (9). A locking device (17, 15) is provided in the next and in the stem in order to keep the shoulder (8) in bearing contact against the seat (9). The applicator and the bottle are provided with a system having corresponding undulations (16) so that opening is effected gradually by rotating the cap (5) slightly about its axis.

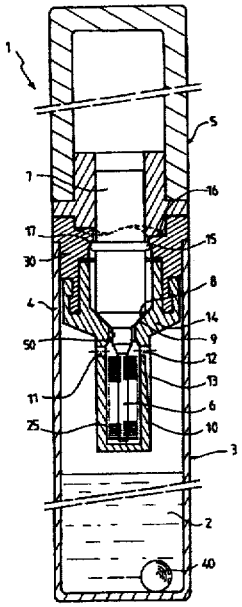

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *